US006154180A

United States Patent [19]

Padrick

[11] Patent Number: 6,154,180

[45] Date of Patent: Nov. 28, 2000

[54] MULTIBAND ANTENNAS

[76] Inventor: David E. Padrick, 1022 Wright Ter., Sunnyvale, Calif. 94087

[21] Appl. No.: 09/146,725

[22] Filed: Sep. 3, 1998

[51] Int. Cl.[7] ..... H01Q 1/00; H01Q 21/12

[52] U.S. Cl. ..... 343/722; 343/815; 343/819; 343/833; 343/834

[58] Field of Search ..... 343/722, 742, 343/810, 815, 816, 817, 818, 819, 820, 833, 834

[56] References Cited

U.S. PATENT DOCUMENTS

| | | | |
|---|---|---|---|
| 2,897,497 | 7/1959 | Finneburgh, Jr. | 343/815 |
| 3,487,415 | 12/1969 | Simons | 343/814 |
| 3,503,074 | 3/1970 | Carter | 343/814 |
| 3,875,572 | 4/1975 | Kay | 343/814 |
| 4,290,071 | 9/1981 | Fenwick | 343/819 |
| 4,352,111 | 9/1982 | Carlson et al. | 343/860 |
| 4,509,056 | 4/1985 | Ploussios | 343/791 |
| 4,593,289 | 6/1986 | Newcomb | 343/795 |
| 4,785,308 | 11/1988 | Newcomb | 343/795 |
| 5,243,358 | 9/1993 | Sanford et al. | 343/836 |
| 5,422,650 | 6/1995 | Hill | 343/713 |
| 5,521,608 | 5/1996 | Brandt et al. | 343/810 |
| 5,841,406 | 11/1998 | Smith | 343/815 |

OTHER PUBLICATIONS

"Introducing the Most Powerful Tribander Ever Produced." Page 14 of Force 12 1998 Product Line Brochure (#98.1).

"Transmission Lines," 1998 *The ARRL Handbook for Radio Amateurs*, Published by: The American Radio Relay League, Newington, CT 06111 USA, Seventy–Fifth Edition, pp. 19.8–19.10.

Advertisement for Cushcraft X7 and X9 Triband Antennas (back page of *NCJ National Contest Journal*, Mar., Apr. 1998, vol. 26, No. 2.).

"Two Band HF Antenna With Automatic Band Switching," *The ARRL Antenna Book, 18th* Edition, The American Radio Relay League, Newington, CT, 1997, pp. 16–17 through 16–21.

Vertical Arrays, John Devoldere, *Antennas and Techniques for Low–Band DXng*, Copyright 1994 by The American Radio League, Inc., Pub. No. 74 of the Radio Amateur's Library. Second Edition, pp. 11–21/22.

"HF Antennas for All Locations," Les Moxon, Radio Society of Great Britain, Second Edition, 1993 pp. 132, 133, 198, 202.

"Multi Monobanders" *Array of Light*,Force 12 Antennas and Systems, Santa Clara, CA 1995 (Booklet 2.001), pp. 31–34.

"The Multiband Beam Antenna, William I. Orr, W6SAI, "*Beam Antenna Handbook*, New 4th Edition, 1971, Radio Publications, Inc.,Box 149, Wilton, Conn. 06897, Chapter X, pp. 127–142.

"All About Cubical Quad Antennas," William I. Orr, W6SAI, *Radio Pubications, Inc.* Box 149, Wilton, Conn. 06897, pp. 50, 77, and 78.

*Primary Examiner*—Tan Ho

*Attorney, Agent, or Firm*—Gallagher & Lathrop; Thomas A. Gallagher

[57] ABSTRACT

A parasitic antenna array (Yagi-Uda or loop type) for multiple frequency bands has its driven and parasitic elements interlaced on a single support boom. In a first aspect of the invention, series resonant circuits are located in one or more parasitic director elements in order to minimize the deleterious mutual coupling effect between directors of different frequency bands. In a second aspect of the invention, an inductance is placed across the feed point of the driven element of one or more non-selected frequency bands in order to minimize the bandwidth narrowing effect of closely-spaced driven elements and to provide a desired feed point impedance at the driven element of the selected frequency band. Although the two aspects of the invention may be used without one another, they are advantageously employed together. In addition, the second aspect of the invention may be applied to closely-spaced driven elements that are not part of a parasitic array.

22 Claims, 2 Drawing Sheets

MULTIBAND ANTENNAS

FIELD OF THE INVENTION

The present invention relates to antennas, particularly to parasitic array antennas. More particularly, the invention relates to parasitic array antennas for more than one frequency band, often referred to as "multiband beam" antennas. Although the invention is described in connection with high-frequency (HF) antennas, the invention is applicable to antennas for use in other frequency ranges, including, for example the very-high-frequency (VHF) and ultra-high-frequency (UHF) ranges.

BACKGROUND OF THE INVENTION

It is often desired to provide a single antenna having directional performance in multiple frequency bands. Many radio services have assigned frequencies in bands of frequencies scattered through the usable radio spectrum. One example is the amateur radio service that has frequency assignments in various high-frequency bands including bands centered at or near 10, 12, 15, 17, 20, 30, 40, 80 and 160 meters. Directional and rotatable parasitic array antennas are widely used by radio amateurs in the 10 through 40 meters bands. Although separate directional and rotatable antennas for each band ("monoband beams") are used by many radio amateurs, it is more common to use multiband parasitic arrays, particularly for the 10, 15 and 20 meter bands (a so-called "triband beam," "triband yagi" or, simply "tribander" in the case of a Yagi-Uda type antenna or a "triband quad," in the case of a quad type antenna) (both the yagi antenna and the quad antenna are endfire multielement array antennas, the yagi employing half-wave dipole elements and the quad employing full-wave loop elements, typically in a square or diamond shape).

In order to minimize space, weight and cost, triband beams and quads typically employ a single support boom with yagi or quad elements, respectively, spaced along the boom. In the case of a triband yagi, multiband operation may be achieved by interlacing dedicated yagi elements for each band or by employing yagi elements having "traps" so that one element operates on three bands.

"Traps" are parallel-resonant circuits located at two symmetrical points with respect to the midpoint of a yagi dipole element. Traps decouple a portion of the element automatically as the antenna operation is changed from band to band. The high impedance of the parallel resonant circuit near its resonant frequency isolates or decouples unwanted portions of the antenna element. Thus, for a 10/15/20 meter triband beam, a first set of traps, the inboard traps, resonate at 10 meters and are located so that only the central portion of dipole element, resonating at 10 meters is active. The second set of traps, the outboard traps, resonate at 15 meters, and are located so that the central portion of the dipole element in combination with the shortening effect of the 10 meter traps and a further length of element between the 10 and 15 meter traps are active and resonate at 15 meters. The remaining portion of the element has a length such that the overall combination resonates at 20 meters. A common configuration is a so-called "three element trapped triband beam" in which each of three elements, a reflector, a driven element and a director each employ traps in order to provide three element yagi operation on 10, 15 and 20 meters.

While providing reasonable gain and directivity for their size, weight and cost, three element trapped triband beams are subject to inherent shortcomings, including, for example, the inability to optimize performance for all three bands (the same element spacing is necessarily required for all three bands) and losses in the traps themselves.

It is also know to use a combination of one or more trapped elements with interlaced, untrapped elements in an attempt to overcome some of the shortcomings of three element triband beams.

Another approach to three band operation, briefly mentioned above, is to eliminate all traps and interlace only non-trapped elements. While this approach has the benefit of eliminating trap loss, other problems arise from the interaction of the larger number of elements resulting from cross coupling. A three element triband beam configured with non-trapped interlaced elements requires nine elements, clustered in three groups, each having three elements (i.e., groups of reflectors, driven elements and directors). One aspect of the undesirable cross coupling is that the impedance of the 10 and 15 meter driven elements are adversely affected by the presence of the other closely spaced driven elements. Another aspect of the undesirable cross coupling is that the directivity pattern on 10 and 15 meters cannot be made appreciably better than the directivity pattern achievable without 10 and 15 meter director elements.

One attempt to overcome the problem of driven elements adversely affecting the impedance of one another is to employ so-called "sleeve" driven elements, in which only one of the three driven elements is directly driven and the other two driven elements, closely spaced to the directly driven element, are parasitically driven. However, overcoupling, resulting from their close proximity, results in narrowing the effective bandwidth of such driven elements.

One attempt to overcome the problem of lack of improved directivity on 10 and 15 meters is to employ more than one director for those frequency bands. However, the use of additional antenna elements adds to the wind load, weight and cost of the antenna.

Various other multiband configurations are known in the art including log periodic arrays and combination log periodic and Yagi-Uda designs in which the driven elements consist of a log periodic cell and the remaining elements include trapped and/or non-trapped interlaced parasitic elements. While providing continuous frequency coverage, log periodic arrays suffer from poor directional performance. One prior art triband beam design employs non-trapped reflector elements, log-cell driven elements and a trapped director. However, such a design requires an extra driven element (the log-cell requires four elements to cover three bands) and the trapped director cannot be optimally spaced for the multiple bands on which it operates.

Thus, an elusive goal has been to provide a triband beam or quad that has the performance of separate beams and quads each dedicated to a specific band (i.e., "monoband" beams and quads).

SUMMARY OF THE INVENTION

The present invention has two aspects, either of which may be used alone to improve the performance of a multiband parasitic array antenna. However, the two aspects of the invention are preferably used together to provide a multiband parasitic array antenna whose performance is substantially the same as separate monoband parasitic array antennas. While the invention will be described in connection with a preferred embodiment of a Yagi-Uda antenna, the two aspects of the invention are equally applicable to quad beam antennas or hybrid quad/yagi antennas in which one or more antenna elements are quad elements and one or more antenna elements are yagi elements.

The first aspect of the invention is a parasitic antenna array for two or more frequency bands having one or more driven elements for the at least two frequency bands and separate parasitic elements for each of the at least two frequency bands. Each of the separate parasitic elements operates as a director on one of the at least two frequency bands, respectively. At least the parasitic element or elements for the frequency band or bands other than the highest frequency band include a series resonant circuit in each half of the respective parasitic element in the case of a yagi element or, in the case of a quad element, in each quarter of the respective parasitic element. The resonant circuit has a resonant frequency substantially in the frequency band in which the respective parasitic element functions as a director, thereby acting as a short circuit in that frequency band and as an open circuit in the other frequency band or bands. The series resonant circuits are located at positions substantially symmetrically spaced along the element such that for the frequency band or frequency bands other than the frequency band in which the parasitic element functions as a director, the parasitic element is electrically broken into portions that reduce the effect of the parasitic element on the radiation pattern of the antenna array in the other frequency band or bands.

In accordance with the second aspect of the invention, an antenna for two or more frequency bands has separate closely-spaced elements for each of the at least two frequency bands, each of the separate elements operative as a driven element on one of the at least two frequency bands, respectively. A transmission feed line is coupled to each of the elements, respectively. A switch couples an input for a further transmission feed line to a selected one of the transmission feed lines and shorts the non-selected transmission feed lines. At least the respective transmission feed line or feed lines coupled to the element or each of the elements for the frequency band or the frequency bands, respectively, other than the highest frequency band, has a length such that, when shorted in the non-selected switch position, it causes the element in the next highest frequency band to have a desired impedance, such as an impedance substantially the same as the element would have if the element having the shorted transmission line were not present. Although the second aspect of the invention may be used in an antenna having no parasitic elements, the second aspect of the invention preferably is used to overcome the interaction problem of closely spaced driven elements in a multiband parasitic array. When used in a parasitic array, the second aspect of the invention allows not only control of the driven element feed point impedance of the selected driven element but it also decouples the driven element(s) of the non-selected frequency band(s) from the selected driven element thereby reducing overcoupling between or among the driven elements that cause narrowing of the antenna's bandwidth.

In a preferred embodiment of the invention, a triband yagi array is provided in which both the first and second aspects of the invention are employed.

DETAILED DESCRIPTION OF THE INVENTION

The goal of the present invention is to provide a multiband parasitic array antenna made up of non-trapped interleaved elements in which the mutual or cross-coupling among elements is minimized such that the antenna performance closely approaches that of separate monoband antennas. Although the invention will be described in connection with the preferred embodiment of a three-band (or triband) high-frequency yagi antenna having three elements on each of the three bands (a total of nine elements), it is to be understood that the invention is not limited to the preferred embodiment.

Figure 1:
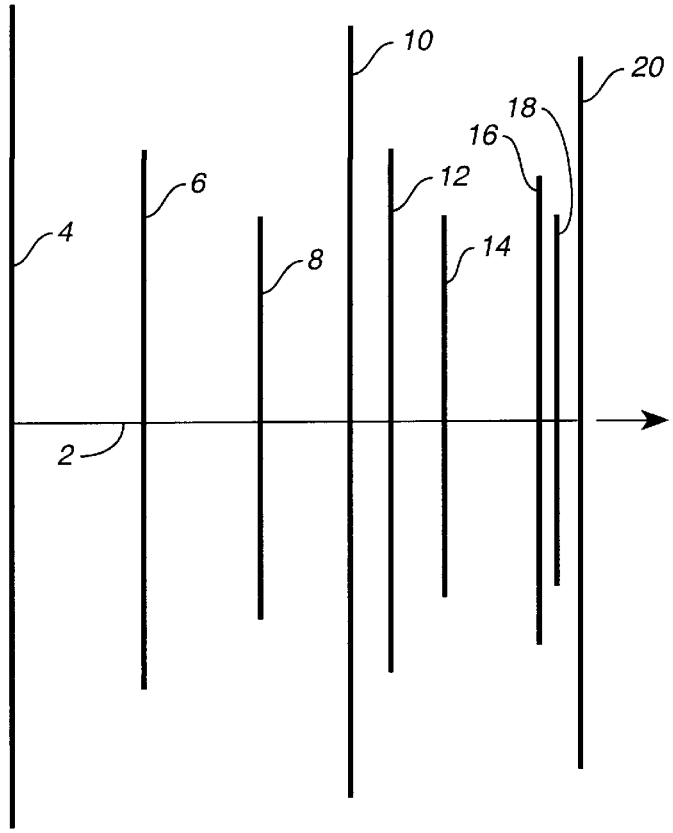
FIG. 1 shows a schematic plan view of a theoretical triband yagi antenna employing non-trapped interlaced elements for 10, 15 and 20 meters that does not employ any aspects of the present invention.

FIG. 1 shows a schematic plan view of a theoretical triband yagi antenna for 10, 15 and 20 meters that does not employ any aspects of the present invention. The direction of primary radiation is shown by the arrow. Interleaved non-trapped elements are used on each band, thus there are nine elements supported by a common boom 2: three reflectors (a 20 meter reflector 4 , a 15 meter reflector 6, and a 10 meter reflector 8) spaced from one another and clustered at one end of the boom, three driven elements (a 20 meter driven element 10, a 15 meter driven element 12, and a 10 meter driven element 14) spaced from one another and clustered centrally on the boom, and three directors (a 15 meter director 16, a 10 meter director 18, and a 20 meter director 20) spaced from one another and clustered at the end of the boom distal from the reflector elements. The sequence of elements within each cluster (reflectors, driven elements, and directors) may be reordered from that shown and as may be their relative spacings and lengths. As is conventional in a parasitic yagi array, each element is nominally a half-wave dipole at its design frequency and all elements lie generally in the same plane.

The present inventor has found that when one attempts to optimize the element spacings and locations, sequence of elements within clusters (reflectors, driven elements, directors), element lengths and the boom length of a triband interlaced element yagi array such as that represented by FIG. 1, that several problems are manifested. Such optimization may employ one or ones of various off-the-shelf antenna modeling software. Simulations referred to herein were made using NEC-4 (Licensed through Lawrence Livermore National Laboratory) and "EZNEC PRO" (EZNEC PRO is a trademark of Roy Lewallen, W7EL software).

The first problem is that no improvement in directional pattern (i.e., front-to-back ratio and front-to-side ratio) seems possible on 10 and 15 meters by the employment of single directors for 10 and 15 meters, respectively. In other words, when employing directors for 10, 15 and 20 meters, the antenna's directional pattern on 10 and 15 meters is no better than, and is perhaps worse, than if the 10 and 15 meter directors were not present.

The inventor has determined that the antenna pattern improvement that one would expect from the use of a 10 meter director is disrupted by the presence of the 15 meter and 20 meter directors and that the antenna pattern improvement that one would expect from the use of a 15 meter director is disrupted by the presence of the 20 meter director. How to overcome the deleterious mutual coupling effect on the 10 and 15 meter antenna performance caused by the presence of the 15 and 20 meter directors, respectively, while retaining the 20 meter director and its beneficial effect on that band and obtaining the full benefit of directors for 10 and 15 meters, respectively, is the subject of the first aspect of the invention. In other words, it is desired to make the 20 meter director appear electrically invisible to the 15 meter director and to make the 20 and 15 meter directors appear electrically invisible to the 10 meter director so that each may function optimally. Furthermore, this should be accomplished automatically without any requirement to physically change any of the director elements when the operation of the antenna is changed from band to band.

In accordance with this first aspect of the present invention, series resonant circuits are placed in the 20 and 15 meter director elements at locations along the respective director elements, the 20 meter circuit being series resonant within the 20 meter band and the 15 meter circuit being resonant within the 15 meter band. These series resonant circuits, which may be referred to as "isolators," appear as a short circuit at and near their resonant frequency (e.g., within the 20 and 15 meter bands, respectively) but appear as an open circuit for frequencies removed from their resonant frequency.

Thus, at 10 and 15 meters, the 20 meter isolators act as open circuits, breaking the 20 meter director electrically into pieces separated by isolators. Similarly, at 10 and 20 meters, the 15 meter isolators act as open circuits, thus breaking the 15 meter director electrically into pieces separated by isolators. Since the 20 meter director affects the 10 and 15 meter directors' effectiveness, the location of the 20 meter isolators are chosen to minimize cross-coupling of the 20 meter director to the 10 and 15 meter directors. Similarly, since the 15 meter director also affects the 10 meter director's effectiveness, the location of the 15 meter isolators are chosen to minimize cross-coupling of the 15 meter director to the 10 meter director.

Isolators in accordance with the present invention function differently from and serve a different purpose than the parallel resonant traps employed in prior art multiband trapped element arrays.

In a simulation of a triband yagi incorporating this aspect of the invention, a distance of fifty inches, plus or minus several inches, from the element center has been found to be the optimum location of the 20 meter isolators. The 20 meter isolators may consist of an LC (inductive capacitive) series circuit having a capacitor with a value of about 25 picofarad and an inductor having a value of about 5 microhenry. In the same simulation of a triband yagi incorporating this aspect of the invention, a distance of forty inches, plus or minus several inches, from the element center has been found to be the optimum location of the 15 meter isolators. The 15 meter isolators may consist of an LC (inductive capacitive) series circuit having a capacitor with a value of about 15 picofarad and an inductor having a value of about 3.75 microhenry. Optimum values for the various inductors and capacitors may be affected by element spacing, number of elements and other design parameters.

Preferably, the isolators are very high Q, a Q of 600 or 700, for example. With a high Q in that range, the isolators should have a very low loss and have only a minor effect on the antenna gain (less than a tenth of a dB for each isolator).

Figure 2:
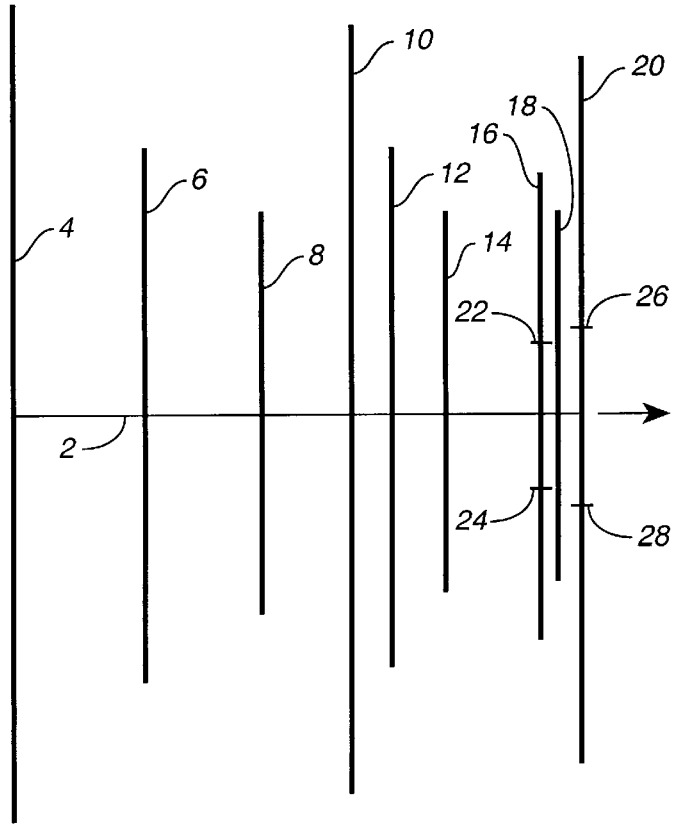
FIG. 2 shows a schematic plan view of a triband yagi antenna for 10, 15 and 20 meters having series resonant circuits (isolators) in the 15 meter and 20 meter directors in accordance with a first aspect of the present invention.

FIG. 2 shows a plan view of a triband yagi employing isolators according to the first aspect of the present invention. The various elements may be arranged in the same manner as the theoretical yagi array shown in FIG. 1 and, thus, the same reference numerals are retained to identify the boom and elements. The direction of primary radiation continues to be shown by the arrow. A pair of isolators 22 and 24 are shown schematically in the 15 meter director element 16 and a pair of isolators 26 and 28 are shown schematically in the 20 meter director element 20.

Details of the physical design of the isolators are not the subject of the present invention. Various known techniques for fabricating parallel resonant antenna element traps are also applicable to the series resonant isolators of the present invention. The isolators should be, for example, weather (rain, sunlight, wind, etc.) resistant, vibration resistant, and sealed to resist to contamination and user adjustment. The isolators should also be integrated into the antenna elements in a manner that minimizes windload while not appreciably affecting element strength.

The use of isolators in director elements is applicable to any multiband parasitic array antenna in which the director for one frequency band adversely affects the performance of a director for another frequency band. Such a multiband parasitic array antenna need not be configured in the manner of the array of FIG. 2. Many alternative configurations are possible, for example: (1) the driven elements need not be separate directly excited elements (instead a single trapped driven element could be employed, sleeve-type driven elements could be employed in which only one element is directly excited and one or more other elements are parasitically excited, or a log-cell cluster of driven elements could be employed); and (2) the elements in the array, including the director elements, need not all be yagi-type elements (some or all could be quad- or other closed-loop-type elements; there could be a mixture of yagi-type and quad- or other closed-loop-type elements). When employed in a quad- or other closed-loop-type director element in which the closed loop is nominally a full wavelength at its design frequency, four instead of two isolators are required, the isolators being spaced in each quarter of the loop with respect to the two maximum current locations of the loop rather than with respect to the center of the yagi element (isolator locations inward, i.e., toward the current maximum point, of about one-eighth wavelength from the current maxima are believed to be appropriate).

Multiband parasitic arrays employing the first aspect of the invention optionally may employ one or more yagi elements or loop elements that are physically reduced in size by the use of, for example, loading coils or linear loading. Such techniques may reduce the physical element size while providing electrical characteristics of a full-size element. For example, another possible type of triband antenna according to the first aspect of the invention is a triband antenna for the 30, 17 and 12 meter amateur bands in which the 30 meter elements are shortened by the use of loading coils or linear loading but in which the elements for 17 and 12 meters are full-size elements.

In addition, the multiband parasitic arrays employing the director isolators according to the invention may or may not include parasitic reflector elements (e.g., the only parasitic elements may be directors). Furthermore, the multiband parasitic arrays may include more than one set (or cluster) of directors for each band, in which case isolators are provided, as necessary.

Although in the case of a triband yagi for 10, 15, 20 meters, only one pair of isolators is required in the 15 and 20 meter directors, respectively, other multiband frequency combinations may require more than one pair of isolators in a director in order that the director has substantially no effect on the radiation pattern of the antenna array in the other frequency band or bands. The scope of the invention is intended to cover any multiband antenna having director-type parasitic elements that employ isolators in at least some of the director elements to enhance the performance of the array.

This aspect of the invention is applicable to multiband antennas covering two bands, three bands or even more than three bands. In any case, the director for the highest frequency band typically does not require an isolator, but the director or directors for the other frequency band or bands should include isolators positioned such that the director has less of a deleterious effect on the radiation pattern of the antenna array in the other frequency band or bands.

The second problem addressed by the present invention is that the characteristics of the 10 and 15 meter driven elements are degraded when compared to the characteristics of driven elements in respective 10 and 15 meter monoband antennas: the feed point resistance is lowered, making it more difficult to provide a low-loss direct feed match to a nominal 50 ohm feedline, and, in addition, the bandwidth of the driven element is narrowed due to overcoupling to the driven elements for the other bands.

The inventor has determined that the 15 meter driven element is disrupted by the 20 meter driven element and that the 10 meter driven element is disrupted by the 15 meter driven element. How to overcome the deleterious mutual coupling effect of the presence of the 15 and 20 meter driven elements on the 10 and 15 meter driven elements, respectively, is the subject of the second aspect of the invention. In other words, it is desired to make the 20 meter driven element appear electrically invisible to the 15 meter driven element and to make the 15 meter driven element appear electrically invisible to the 10 meter driven element so that each may function optimally. Furthermore, this should be accomplished simply as part of the selection of the frequency band on which the antenna is to operate at any particular time.

In accordance with the second aspect of the present invention, an inductance is shunted across the feed point of the 20 meter and 10 meter driven element feed points when 15 meter operation is selected and an inductance is shunted across at least the feed point of the 15 meter driven element feed point when 10 meter operation is selected. In a practical embodiment of the invention, the connection of an inductance across the feed point of a driven element is most easily accomplished by shorting a section of feedline, less than a quarter wavelength, that is connected to the driven element feed point. As is well known, a transmission line less than a quarter wavelength appears inductive at its input when shorted at its far end. This arrangement for shorting lengths of transmission line preferably is part of a remotely-controlled selector arrangement for selecting the desired band of operation of the multiband antenna.

Thus, separate lengths of transmission line (50 ohm coaxial cable, for example) have one end connected to the feed point of each driven element, respectively. The other end of each feed line is connected to a switching arrangement (in a practical arrangement, employing one or more relays). The switching arrangement selectably connects one of the lengths of feed line to a feed line that may be coupled to a transmitter, receiver or transceiver. A separate control line may be run to the transmitter, receiver or transceiver location for remote control of the switching arrangement or control signals may be imposed on the feedline itself. In addition to selecting the desired driven element, the switching arrangement also shorts the 20 meter and 10 meter feedlines when 15 meter operation is selected and shorts at least the 15 meter feedline when 10 meter operation is selected. As a matter of convenience in the design of the switching arrangement, selection of the 10 meter operation may also cause shorting of the 20 meter feedline; however, it is not believed necessary to do so.

The length of the 20 meter feedline between the 20 meter driven element and the switching arrangement and the length of the 10 meter feedline between the 10 meter driven element and the switching arrangement are such that when each is shorted at the switching arrangement, the 15 meter driven element characteristics are optimized. The length of the 15 meter feedline between the 15 meter driven element and the switching arrangement is such that when shorted at the switching arrangement, the 10 meter driven element characteristics are optimized.

Simulations indicate that a substantially non-reactive impedance in the range of 50 ohms, plus or minus 25 ohms or so, may be achieved at the feed point of each driven element (direct feed of the split element at its center) by employing the second aspect of the present invention. Typically, a 50 ohm impedance is desired in order to match commonly-used coaxial cable having a nominal impedance of 50 ohms.

Figure 3:
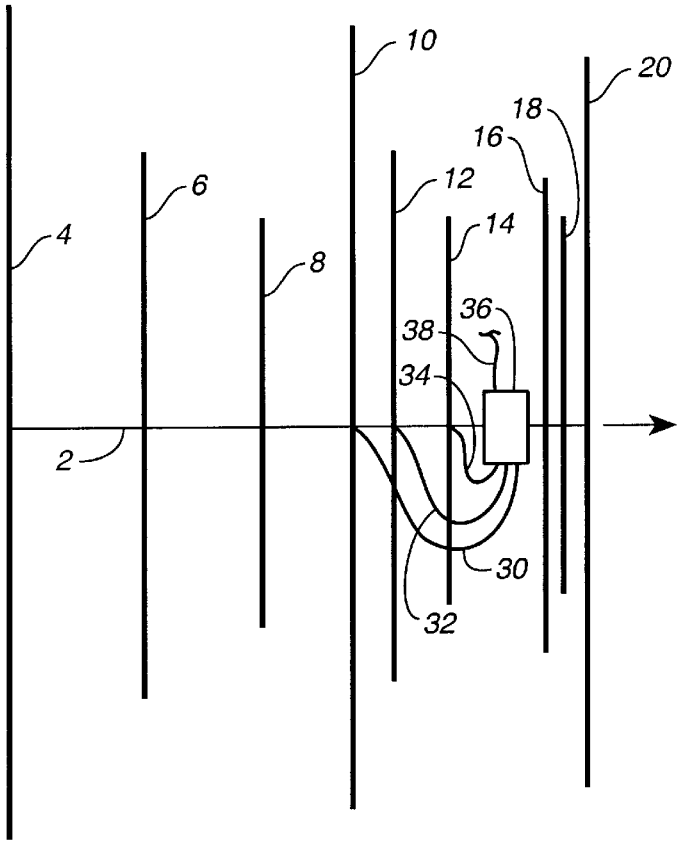
FIG. 3 shows a schematic plan view of a triband yagi antenna for 10, 15 and 20 meters having shorted feedline stubs in accordance with a second aspect of the present invention.

FIG. 3 shows a plan view of a triband yagi employing shorted feedline stubs according to the second aspect of the present invention. The various elements may be arranged in the same manner as the theoretical yagi array shown in FIG. 1 and, thus, the same reference numerals are retained to identify the boom and elements. The direction of primary radiation continues to be shown by the arrow. Feedlines 30, 32 and 34, from the 20 meter, 15 meter and 10 meter directors, respectively, are applied to a switching arrangement, shown as a housing 36 fixed to the antenna boom 2. A feedline 38, shown as a fragment, may connect the switching arrangement to a receiver, transmitter or transceiver, for example. The switching arrangement may include, for example, a multipole, three position relay system configured such that any one of the feedlines 30, 32, or 34 may be coupled to feedline 38 while another feedline may be shorted, as described above. The effective lengths of shorted feedlines are as described above. In a simulation of the second aspect of the invention employing nominally 50 ohm coaxial cable feedlines having a 66% velocity factor, the optimum lengths of the shorted 20 meter and 15 meter feedline stubs were 87.75 inches and 70.25 inches, respectively. Optimum stub lengths may be affected by element spacing, number of elements, coaxial cable impedance, coaxial cable velocity factor and other design parameters.

The second aspect of the present invention is not limited to use in a parasitic array, but may be employed with multiband closely spaced driven elements that do not have any parasitic elements associated with them.

Figure 4:
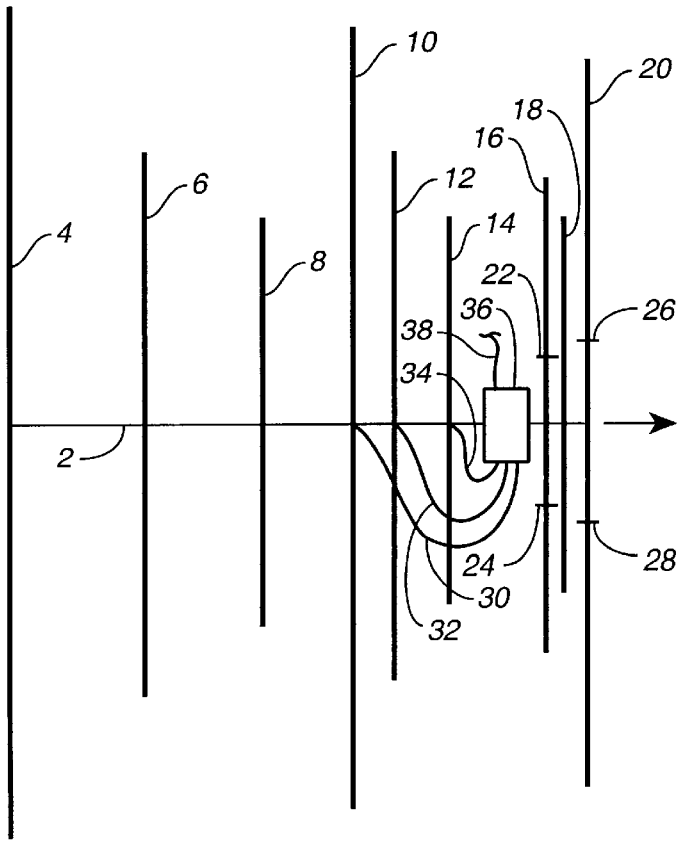
FIG. 4 shows a schematic plan view of a triband yagi antenna for 10, 15 and 20 meters having series resonant circuits (isolators) in the 15 meter and 20 meter directors in accordance with a first aspect of the present invention and having shorted feedline stubs in accordance with a second aspect of the present invention.

In a preferred embodiment, both aspects of the invention are employed in a triband yagi antenna as shown in FIG. 4. The descriptions of FIGS. 2 and 3 are applicable to FIG. 4. Simulations indicate that the following dimensions are optimum for the preferred embodiment of FIG. 4 (where 20M R means 20 meter reflector, etc., dimensions are in inches, element locations are positions along boom):

| | Element Location | Element Half Length | Element Tip Length |
|---|---|---|---|
| 20M R | 0.0 | 221.25 | 73.5 |
| 15M R | 74.25 | 143.5 | 62.5 |
| 10M R | 140.0 | 106.0 | 70.0 |
| 20M DE | 188.75 | 210.125 | 62.125 |
| 15M DE | 212.75 | 138.75 | 57.75 |
| 10M DE | 242.75 | 101.125 | 65.125 |
| 15M D | 295.25 | 126.5 | 45.5 |
| 10M D | 304.25 | 93.0 | 57.0 |
| 20M D | 316.0 | 191.5 | 43.5 |

In addition, the dimensions in the above table assume that the elements are formed from multiple sections of aluminum tubing having the following taper schedule (each element half, starting at the boom):

20M: 72"×1.25" (O.D.); 32"×1.0"; 44"×0.75"; --"×0.50"

15M: 48"×1.0; 33"×0.75; --"×0.50"

10M: 36"×0.75"; --"×0.50".

All element sections that couple to a smaller outside diameter element section are taper swaged (the swaged portions being about 3 inches each). In a practical antenna, the various element sections may be secured together in any one of various known ways, including, for example, self-tapping screws, nuts and bolts, rivets, and hose clamps.

Each 20 meter, 15 meter and 10 meter element, respectively, is the same except for the half inch O.D. tip segment. The respective tip dimensions (--"×0.50") are indicated in the table above. The simulation from which the above dimensions were derived assumes a zero length for the director isolators. In a practical antenna the isolators will, of course, have a length. One way to build the directors of a practical antenna from the above given dimensions would be to adjust, in isolation, apart from the other elements, the length of the director with its isolators in place such that its resonant frequency is that of the simulated director element. In building a practical antenna, adjustments to the simulated lengths of all the elements may be necessary to compensate for element mounting bracket effects, and other practical physical construction effects.

It should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

I claim:

1. A parasitic antenna array for at least two frequency bands, comprising one or more driven elements for said at least two frequency bands, separate parasitic elements for each of said at least two frequency bands, each of said separate parasitic elements operative as a director on one of said at least two frequency bands, respectively, at least the parasitic element or elements for the frequency band or bands other than the highest frequency band having at least one series resonant circuit in each half of the respective parasitic element when the parasitic element is a yagi element and including a series resonant circuit in each quarter of the parasitic element when the parasitic element is a loop element, the resonant circuit having a resonant frequency substantially in the frequency band in which the respective parasitic element functions as a director, thereby acting as a short circuit in said frequency band and as an open circuit in the other frequency band or bands, the series resonant circuits being located at positions substantially symmetrically spaced along the element such that for the frequency band or frequency bands other than the frequency band in which the parasitic element functions as a director, the parasitic element is electrically broken into portions that reduce the effect of the parasitic element on the radiation pattern of the antenna array in said other frequency band or bands.

2. The parasitic antenna array of claim 1 wherein said antenna array is a Yagi-Uda type array.

3. The parasitic antenna array of claim 1 wherein said antenna array is a quad type array.

4. The parasitic antenna array of claim 1 where in said antenna array is a hybrid Yagi-Uda and quad type array.

5. The parasitic antenna array of claim 1 wherein said antenna array is for three frequency bands.

6. The parasitic antenna array of claim 5 wherein said three frequency bands are the 10, 15 and 20 meter bands.

7. The parasitic antenna array of claim 1 further comprising one or more additional parasitic elements for said at least two frequency bands, said one of more additional parasitic elements operative as a reflector in said at least two frequency bands, respectively.

8. The parasitic antenna array of claim 1 further comprising one or more additional sets of parasitic elements for said at least two frequency bands, said one of more additional sets of parasitic elements operative as directors, each set of additional sets of parasitic elements operative as directors having separate parasitic elements for each of said at least two frequency bands, each of said separate parasitic elements operative as a director on one of said at least two frequency bands, respectively, at least the parasitic element or elements for the frequency band or bands other than the highest frequency band including a series resonant circuit in each half of the respective parasitic element when the parasitic element is a yagi element and including a series resonant circuit in each quarter of the parasitic element when the parasitic element is a loop element, the resonant circuit having a resonant frequency substantially in the frequency band in which the respective parasitic element functions as a director, thereby acting as a short circuit in said frequency band and as an open circuit in the other frequency band or bands, the series resonant circuits being located at positions substantially symmetrically spaced along the element such that for the frequency band or frequency bands other than the frequency band in which the parasitic element functions as a director, the parasitic element is electrically broken into portions that reduce the effect of the parasitic element on the radiation pattern of the antenna array in said other frequency band or bands.

9. The parasitic antenna array of claim 1 wherein said one or more driven elements for said at least two frequency bands comprise separate directly excited driven elements for each of said at least two frequency bands, respectively.

10. The parasitic antenna array of claim 1 wherein said one or more driven elements for said at least two frequency bands comprise separate driven elements for each of said at least two frequency bands, respectively, wherein only one of said driven elements are directly excited.

11. The parasitic antenna array of claim 1 wherein said one or more driven elements for said at least two frequency bands comprises a single driven element operative on said at least two frequency bands.

12. The parasitic antenna array of claim 1 wherein said one or more driven elements for said at least two frequency bands comprises a log-cell cluster operative on said at least two frequency bands.

13. An antenna for at least two frequency bands, comprising separate, closely-spaced, elements for each of said at least two frequency bands, each of said separate elements operative as a driven element on one of said at least two frequency bands, respectively, a plurality of transmission feed lines each transmission feed line having two conductors, each transmission feed line coupled to one of said elements, respectively, a switch, said switch coupling an input for a further transmission feed line having two conductors to a selected one of said transmission feed lines and shorting the conductors of at least one of the non-selected transmission feed lines, and said at least one of the non-selected transmission feed lines having a length such that, when its conductors are shorted, it causes the element coupled to the selected transmission feed line to have substantially a predetermined impedance and also to have a wider bandwidth than if the element having its transmission line shorted by said switch did not have its transmission line shorted by said switch, or the elements having their transmission lines shorted by said switch did not have their transmission lines shorted by said switch.

14. The parasitic antenna array of claim 13 wherein said antenna array is for three frequency bands.

15. The parasitic antenna array of claim 14 wherein said three frequency bands are the 10, 15 and 20 meter bands.

16. The parasitic antenna array of claim 14 wherein said switch shorts at least feedline for the element for the next lower frequency band when the element for the highest frequency band is selected.

17. The parasitic antenna array of claim 14 wherein said switch shorts the conductors of the feedlines for the elements for the highest and lowest frequency bands when the element for the middle frequency band is selected.

18. A parasitic antenna array for at least two frequency bands, comprising separate, closely-spaced, elements for each of said at least two frequency bands, each of said separate elements operative as a driven element on one of said at least two frequency bands, respectively, a transmission feed line coupled to each of said elements, respectively, a switch, said switch coupling an input for a further transmission feed line to a selected one of said transmission feed lines and shorting at least one of the non-selected transmission feed lines, said at least one of the non-selected transmission feed lines having a length such that, when shorted, causes the element coupled to the selected transmission feed line to have a predetermined impedance and to have a wider bandwidth than if the element having the shorted transmission line, or the elements having the shorted transmission lines, did not have its transmission line shorted or their transmission lines shorted, respectively, and separate parasitic elements for each of said at least two frequency bands, each of said separate parasitic elements operative as a director on one of said at least two frequency bands, respectively, at least the parasitic element or elements for the frequency band or bands other than the highest frequency band including at least one series resonant circuit in each half of the respective parasitic element when the parasitic element is a yagi element and including a series resonant circuit in each quarter of the parasitic element when the parasitic element is a loop element, the resonant circuit having a resonant frequency substantially in the frequency band in which the respective parasitic element functions as a director, thereby acting as a short circuit in said frequency band and as an open circuit in the other frequency band or bands, the series resonant circuits being located at positions substantially symmetrically spaced along the element such that for the frequency band or frequency bands other than the frequency band in which the parasitic element functions as a director, the parasitic element is electrically broken into portions that reduce the effect of the parasitic element on the radiation pattern of the antenna array in said other frequency band or bands.

19. A parasitic antenna array having three elements on each of three frequency bands, comprising separate, closely-spaced, elements for each of said three frequency bands, each of said separate elements operative as a driven element on one of said three frequency bands, respectively, a transmission feed line coupled to each of said elements, respectively, a switch, said switch coupling an input for a further transmission feed line to a selected one of said transmission feed lines and shorting at least one of the non-selected transmission feed lines, said at least one of the non-selected transmission feed lines having a length such that, when shorted, causes the element coupled to the selected transmission feed line to have a predetermined impedance and to have a wider bandwidth than if the element having the shorted transmission line, or the elements having the shorted transmission lines, did not have its transmission line shorted or their transmission lines shorted, respectively, and a first set of separate parasitic elements for each of said three frequency bands, each of said separate parasitic elements operative as a director on one of said three frequency bands, respectively, the parasitic element for the frequency bands other than the highest frequency band including at least one series resonant circuit in each half of the respective parasitic element when the parasitic element is a yagi element and including a series resonant circuit in each quarter of the parasitic element when the parasitic element is a loop element, the resonant circuit having a resonant frequency substantially in the frequency band in which the respective parasitic element functions as a director, thereby acting as a short circuit in said frequency band and as an open circuit in the other frequency bands, the series resonant circuits being located at positions substantially symmetrically spaced along the element such that for frequency bands other than the frequency band in which the parasitic element functions as a director, the parasitic element is electrically broken into portions that reduce the effect of the parasitic element on the radiation pattern of the antenna array in said other frequency band or bands, and a second set of separate parasitic elements for each of said three frequency bands, each of said separate parasitic elements operative as a reflector on one of said three frequency bands, respectively.

20. A method of constructing a parasitic antenna array for at least two frequency bands, comprising providing one or more driven elements for said at least two frequency bands, providing separate parasitic elements for each of said at least two frequency bands, each of said separate parasitic elements operative as a director on one of said at least two frequency bands, respectively, at least the parasitic element or elements for the frequency band or bands other than the highest frequency band including a series resonant circuit in each half of the respective parasitic element when the parasitic element is a yagi element and including a series resonant circuit in each quarter of the parasitic element when the parasitic element is a loop element, the resonant circuit having a resonant frequency substantially in the frequency band in which the respective parasitic element functions as a director, thereby acting as a short circuit in said frequency band and as an open circuit in the other frequency band or bands, the series resonant circuits being located at positions substantially symmetrically spaced along the element such that for the frequency band or frequency bands other than the frequency band in which the parasitic element functions as a director, the parasitic element is electrically broken into portions that reduce the effect of the parasitic element on the radiation pattern of the antenna array in said other frequency band or bands.

21. A method of constructing an antenna for at least two frequency bands, comprising providing separate, closely-spaced, elements for each of said at least two frequency bands, each of said separate elements operative as a driven element on one of said at least two frequency bands, respectively, and switchably inserting an inductance in the element for at least the lower or lowest frequency band when the element for the next higher frequency band is selected as the active element for transmission or reception, the inductance having a fixed value such that the inductance causes the element in the next highest frequency band to have substantially a predetermined impedance and to have a wider bandwidth than if the element having the inserted inductance did not have an inductance inserted.

22. The method of claim 21 wherein the antenna is for three frequency bands, wherein the step of switchably inserting an inductance comprises switchably inserting an inductance in the element for the highest and lowest frequency bands when the element for the middle frequency band is selected.

* * * * *